US012486853B1

(12) United States Patent
Balconi

(10) Patent No.: US 12,486,853 B1
(45) Date of Patent: Dec. 2, 2025

(54) SYMMETRICAL RADIALLY SPLIT CENTRIFUGAL MULTISTAGE THRUSTLESS PUMP

(71) Applicant: Flowserve Pte. Ltd., Singapore (SG)

(72) Inventor: Davide Balconi, Renate (IT)

(73) Assignee: Flowserve Pte. Ltd., Singapore (SG)

( * ) Notice: Subject to any disclaimer, the term of this patent is extended or adjusted under 35 U.S.C. 154(b) by 0 days.

(21) Appl. No.: 19/217,019

(22) Filed: May 23, 2025

(51) Int. Cl.
*F04D 29/04* (2006.01)
*F04D 1/00* (2006.01)
*F04D 1/06* (2006.01)
*F04D 29/041* (2006.01)

(52) U.S. Cl.
CPC ..... *F04D 29/041* (2013.01); *F04D 1/006* (2013.01); *F04D 1/063* (2013.01)

(58) Field of Classification Search
CPC ..... F04D 29/041; F04D 1/006; F04D 1/063
See application file for complete search history.

(56) References Cited

U.S. PATENT DOCUMENTS 3,103,892 A * 9/1963 Mcfarland ..... F04D 29/44 415/185
10,859,084 B2 * 12/2020 Valland ..... E21B 43/12
2008/0085185 A1 * 4/2008 Towsley ..... F04D 29/605 415/198.1
2009/0214332 A1 * 8/2009 Towsley ..... F04D 29/426 417/244
2018/0087516 A1 * 3/2018 Osama ..... F04D 13/0646
2018/0238332 A1 * 8/2018 Ripa ..... F04D 29/448
2019/0145415 A1 * 5/2019 Brunvold ..... F04D 29/528 417/423.12
2019/0390683 A1 * 12/2019 Kalgraff ..... F04D 25/16
2022/0178381 A1 * 6/2022 De Raeve ..... F04D 1/06
2023/0018714 A1 * 1/2023 Sakawaki ..... H02K 7/09

* cited by examiner

*Primary Examiner* — Aaron R Eastman
(74) *Attorney, Agent, or Firm* — Maine Cernota & Curran

(57) ABSTRACT

A multistage centrifugal pump having a barrel-type, radially split casing comprises a rotor including oppositely directed first and second impeller groups having equal numbers of impellers, all fixed to a common rotating shaft. Process fluid entering the pump is divided into two equal flows that are directed respectively to inputs of the first and second impeller groups, the two flows being thereby equally pressurized by the impeller groups, and then combined into a common pump outlet flow. The two impeller groups thereby function as substantially identical pumps operating in parallel that apply equal and opposite, cancelling axial thrusts to the rotor. In embodiments, the thrust cancellation of the two impeller groups is sufficient to obviate any need for thrust compensation mechanisms. The centrifugal pump can be a BB4 or BB5 pump. Residual thrust due to a slight asymmetry between the impeller groups can axially stabilize the rotor.

10 Claims, 8 Drawing Sheets

SYMMETRICAL RADIALLY SPLIT CENTRIFUGAL MULTISTAGE THRUSTLESS PUMP

FIELD OF THE INVENTION

The invention relates to multi-stage centrifugal pumps, and more particularly, to thrust compensation of between bearing, multistage, radially split, centrifugal pumps.

BACKGROUND OF THE INVENTION

It is typical in impeller driven pumps for pressure differences to be developed that result in axially directed forces, generally referred to as "thrust," being applied to the rotating shaft, the impellers, and other rotating components, referred to collectively as the "rotor." For example, in a multistage centrifugal pump, each impeller will tend to produce some amount of thrust because of different pressures and different geometries on the two sides of the impeller.

In some cases, the axial thrust forces are absorbed by one or more thrust bearings that axially support the rotating shaft. However, it can be undesirable to require that the thrust bearings absorb all of the thrust that is generated by the impellers. For example, in a high pressure multistage pump the net thrust that is generated may cause unacceptable wear to the thrust bearings unless it is compensated in some manner.

Accordingly, with reference to FIG. 1A, multistage centrifugal pumps 120 often include a thrust compensation mechanism 128, also referred to as a thrust balancing mechanism 128 that at least partially compensates for impeller thrust effects by generating an offsetting thrust, thereby reducing or eliminating the thrust absorbing requirements that are placed on the one or more thrust bearings. FIG. 1A is a sectional side view of a "between-bearings" (BB) multistage centrifugal "in-line" pump that comprises a plurality of identically oriented impellers 100 fixed to and rotating with a shaft 102 and configured to direct a process fluid from an inlet 122 to an outlet 124 via a unidirectional, axial flow path 126. The illustrated pump 120 is a centrifugal, "between bearing," double-casing, radially split pump having the American Petroleum Institute API 610 pump classification type identifier "BB5". Similar single-casing pumps have the API 610 pump classification type identifier "BB4."

The BB5 pump of FIG. 1A implements a balancing "drum" thrust compensation mechanism 128. A simplified example of a drum thrust compensation mechanism 128 is illustrated in FIG. 1B, in which an impeller 100 is fixed to a rotating shaft 102. In this example, process fluid that leaks past the impeller 100 is collected behind the impeller 100 in a leakage chamber 104 formed between the shaft 102 and the pump housing 106. One end of the leakage chamber 104 is bounded by a thrust-balancing "drum" 114, which is fixed to the shaft 102 and separated from the housing 106 by a small, high-tolerance radial gap 110.

The fluid pressure in the leakage chamber 104 tends to remain at a fixed percentage of the impeller outlet pressure. Leakage fluid is able to flow at a limited rate through the radial gap 110 between the drum 114 and the housing 106, and into a collection chamber 112 which is in fluid communication with the pump inlet 122 via a thrust compensation "return line" 108. According to this configuration, the fluid pressure in the collection chamber 112 is approximately equal to the inlet pressure, while the fluid pressure in the leakage chamber 104 is higher than the inlet pressure. As a result, a compensating thrust 116 is applied to the rotating shaft 102 by the balancing drum 114 that is in opposition to the axial thrust 114 applied by the impeller(s) 100. Corresponding elements of the thrust compensation mechanism 128 of FIG. 1A are indicated in the close-up view of FIG. 1C.

A disadvantage of this approach is that the compensating thrust tends to be substantially constant, and does not respond to changes in the axial thrust 114 applied by the impellers 100, which will typically vary at different operating speeds and fluid pressures. As a result, the remaining, uncompensated thrust must be absorbed by the thrust bearings.

With reference to FIG. 2, the thrust that arises in a multi-stage BB4 or BB5 pump 200 can sometimes be reduced by implementing an "opposed" design that includes impellers 100 arranged in two groups 202, 204, wherein the impellers 100 in the first 202 and second 204 groups are oriented in opposite directions, such that the thrust developed by the first group 202 is partially offset by the opposing thrust developed by the second group 204.

It can be seen in FIG. 2 that even though the impellers 100 in the two groups 202, 204 are oppositely oriented, the flow path 206 of the process fluid is shunted from an output of the first group 202 to an input of the second group 204, such that it passes through all of the impellers 100 in series. Accordingly, because each impeller increases the pressure of the process fluid, the fluid pressures within the two groups 202, 204 are different from each other, which causes the opposing thrusts of the two groups 202, 204 to be unequal, such that a residual thrust difference must be further compensated and/or absorbed by thrust compensation mechanisms 128*a*, 128*b* and/or one or more thrust bearings. In the illustrated example, the pump 200 comprises thrust compensation mechanisms 128*a* and 128*b* that have the same function as mechanism 128 of FIG. 1A.

The wear and failure of thrust bearings are a significant cause of failure and down-time for multistage centrifugal pumps such as BB4 and BB5 pumps. Furthermore, the leakage of process fluid in compensation mechanisms 128 from the leakage chamber 104 to the pump inlet 122 results in volumetric and pressure losses, leading to an overall loss of pumping efficiency. This efficiency loss tends to increase over time due to the tight tolerance and consequent wear and galling of the passage 110 that connects the leakage chamber 104 to the collection chamber 112.

What is needed, therefore, is a radially split multistage centrifugal pump, such as a BB4 or BB5 pump, that does not require a thrust compensation or balancing mechanism.

SUMMARY OF THE INVENTION

The present invention is a radially split multistage centrifugal pump, such as a BB4 or BB5 pump, that does not require a thrust compensation or balancing mechanism.

The disclosed pump eliminates axial thrust by implementing a fully symmetric design in which an even number of impellers are arranged in two impeller groups, each having the same number of impellers, wherein the impellers in the first and second groups are oriented in opposite directions.

Unlike the example of FIG. 2, the present invention achieves full symmetry and substantially full thrust compensation by dividing the incoming flow of the process fluid into substantially equal inlet flows that are directed via separate fluid inlets to inputs of the two groups of impellers, such that the two process fluid flows pass through the two impeller groups in parallel, rather than in series. As a result, the fluid pressures, and other mechanical characteristics of the two impeller groups remain substantially identical for all operating inlet pressures, outlet pressures, and operating speeds, such that the axial thrusts applied to the rotating shaft by the two impeller groups are substantially equal to each other. As a result, the applied axial thrusts are equal and opposite at all fluid pressures and operating speeds, such that, in embodiments, thrust compensation mechanisms, and return lines are not needed. Essentially, the two impeller groups function as two identical centrifugal pumps operating in parallel and applying equal and opposed axial thrusts to their common rotating shaft.

A further benefit of the present invention is that, by dividing the impellers into two groups, the minimum input pressure NPSHr (net positive suction head required) that is required to avoid cavitation damage within the pump is less than what would be required for a conventional pump of similar performance in which all of the impellers operated in series.

Due to manufacturing tolerances, a rotating shaft will always have a certain axial "play" or range within which it can move freely if no axial thrust is applied. As a result, if the two impeller groups apply precisely equal and opposed axial thrusts to the rotating shaft, the shaft may tend to make random excursions within its axial range, which can result in damage and/or premature wear to the bearings and/or other mechanical components of the pump.

Accordingly, in some embodiments of the present invention, a small residual axial thrust is intentionally introduced into the pump by providing a slight asymmetry between the two groups of impellers, thereby creating a residual axial thrust that is supported by a thrust bearing. In this way, the shaft is positively maintained at one boundary of its axial range.

In some of these embodiments, the asymmetry is introduced by slightly varying the blade angle of one or more of the impellers, or by varying the outer diameter of one or more impellers. Another approach is to vary the inner diameter of one or more of the impellers, for example by providing wear rings of differing thicknesses. In similar embodiments, the gap that is provided between the impeller wear ring and stator wear ring of at least one of the impellers can be widened, thereby increasing the leakage between the wear rings and introducing a controlled residual axial rotor thrust.

The present invention is a multistage centrifugal pump having a barrel-type radially split casing. A rotor of the centrifugal pump comprises a rotating shaft supported by at least one bearing at each of two opposing ends thereof; a first impeller group comprising a first group of N impellers fixed to the rotating shaft and configured to direct a process fluid in a first axial direction, N being an integer equal to one or greater; and a second impeller group comprising N impellers fixed to the rotating shaft and configured to direct the process fluid in a second axial direction that is opposite to the first axial direction.

The multistage centrifugal pump further comprises a first fluid inlet configured to direct a first flow of the process fluid to an input of the first impeller group for direction thereby in the first axial direction, a second fluid inlet configured to direct a second flow of the process fluid to an input of the second impeller group for direction thereby in the second axial direction, and a common outlet configured to form an outlet flow of the process fluid from the centrifugal pump by combining together the first and second flows of the process fluid after pressurization thereof respectively by the first and second impeller groups. A first axial thrust applied to the rotor by the first impeller group is substantially equal and opposite to a second axial thrust applied to the rotor by the second impeller group.

In embodiments, the centrifugal pump does not comprise a flow compensation mechanism or a thrust compensation return line.

In any of the above embodiments, the centrifugal pump can be a BB4 pump, or a BB5 pump.

In any of the above embodiments, all of the impellers of both of the impeller groups can be substantially identical to one another.

In any of the above embodiments, an impeller of the first group of impellers that is closest to the common outlet can be included in a double-suction impeller that also includes an impeller of the second group of impellers that is closest to the common outlet.

In any of the above embodiments, the first axial thrust can be exactly equal and opposite to the second axial thrust. Or, a residual axial thrust can be applied to the rotor due to a difference between the first and second axial thrusts. In some of these embodiments, the difference between the first and second axial thrusts arises at least in part due to a difference in an outer diameter of one of the impellers of the first impeller group and an outer diameter of a corresponding impeller of the second impeller group. In any of these embodiments, the difference between the first and second axial thrusts can arise at least in part due to a difference in a blade angle of one of the impellers of the first impeller group and a blade angle of a corresponding impeller of the second impeller group. And in any of these embodiments, the difference between the first and second axial thrusts can arise at least in part due to a difference in a fluid leakage between wear rings supporting one of the impellers of the first impeller group and a fluid leakage between wear rings supporting a corresponding impeller of the second impeller group.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a radially split multistage centrifugal pump, such as a BB4 or BB5 pump, that does not require a thrust compensation or balancing mechanism.

Figure 3A:
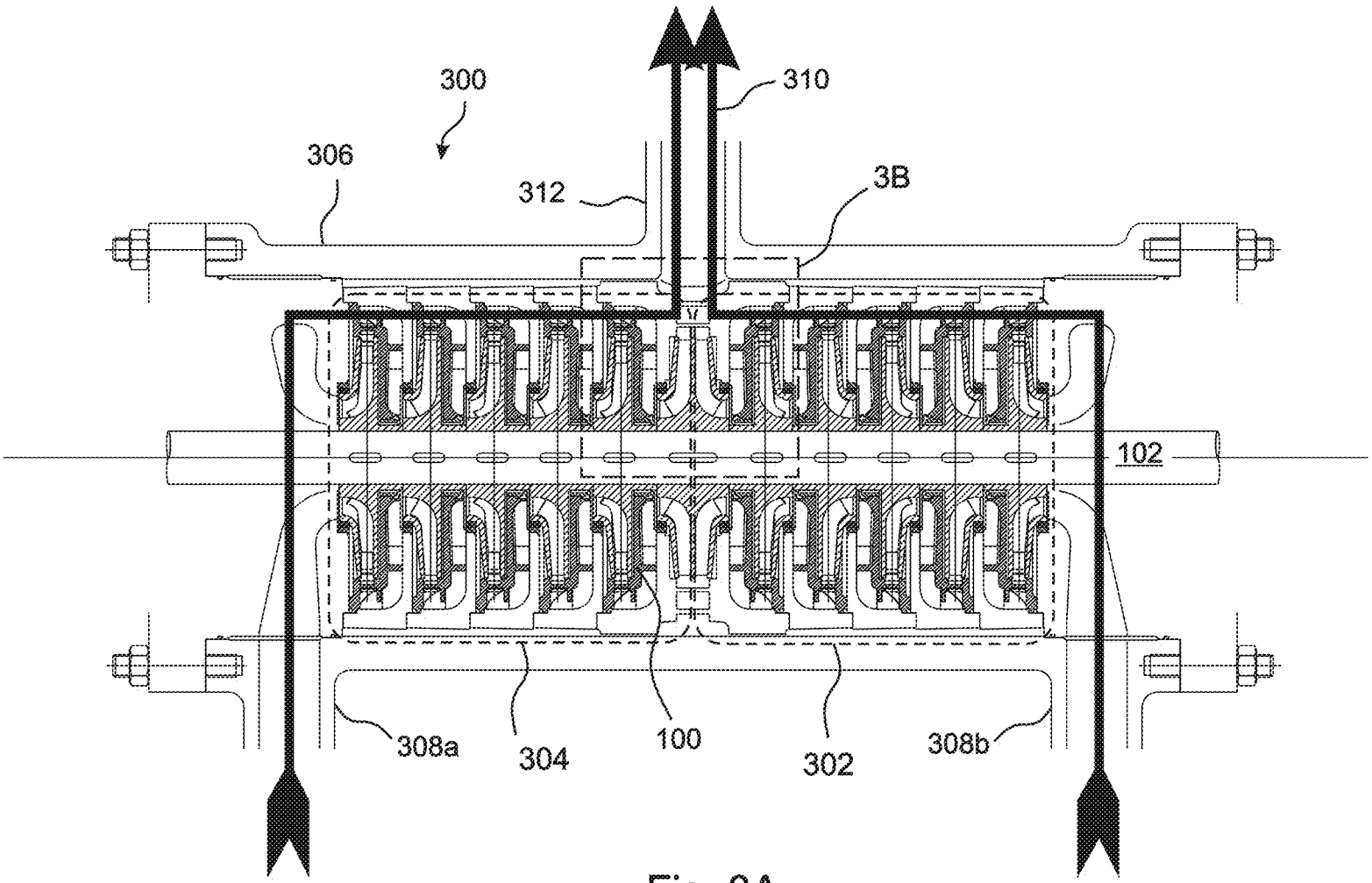
FIG. 3A is a cross-sectional side view of a BB5 pump in an embodiment of the present invention.

With reference to FIG. 3A, the disclosed radially split multistage rotary pump 300 substantially eliminates thrust by implementing a fully symmetric design that comprises an even number of impellers arranged in first 302 and second 304 groups, each having the same number of impellers 100, wherein the impellers 100 in the first 302 and second 304 groups are oriented in opposite directions.

Figure 2:
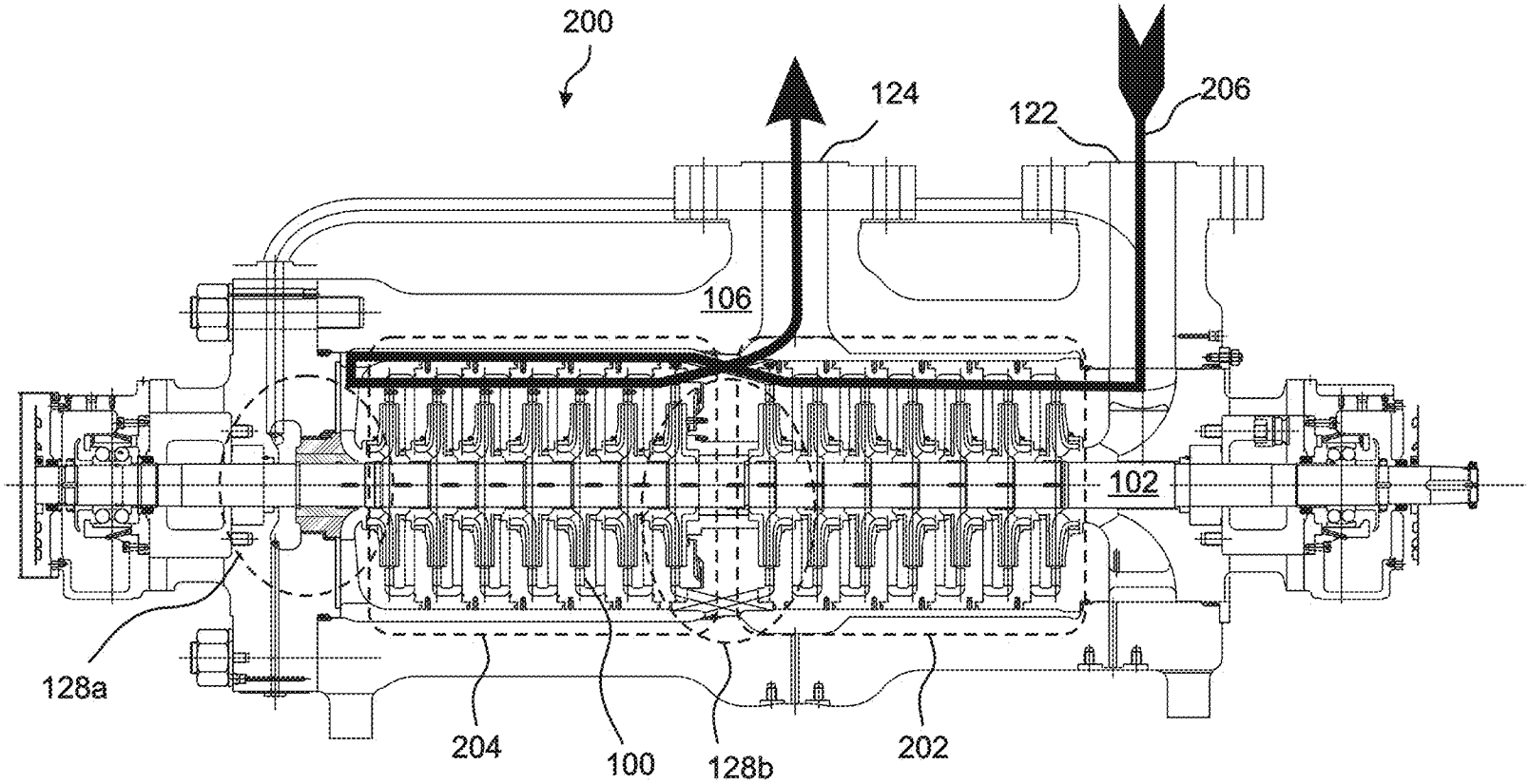
Fig. 2 (prior art)
FIG. 2 is a sectional view of an opposed BB5 pump of the prior art that comprises a thrust compensation mechanism.

Unlike the example of FIG. 2, the present invention 300 achieves full symmetry by providing separate fluid inlets 308*a*, 308*b* for the two impeller groups 302, 304, such that the flow path 310 directs the process fluid to flow through the two impeller groups 302, 304 in parallel to a common fluid outlet 312, rather than in series. As a result, the fluid pressures, and other mechanical characteristics of the two impeller groups 302, 304 remain substantially identical for all operating inlet pressures, outlet pressures, and operating speeds, such that the axial thrusts applied to the rotating shaft by the two impeller groups 302, 304 are substantially equal to each other. As a result, the applied axial thrusts are equal and opposite at all fluid pressures and operating speeds, such that thrust compensation mechanisms and return lines are not needed. Essentially, the two impeller groups 302, 304 function as two identical pumps operating in parallel and applying equal and opposed thrusts to their common rotating shaft 102.

Figure 1A:
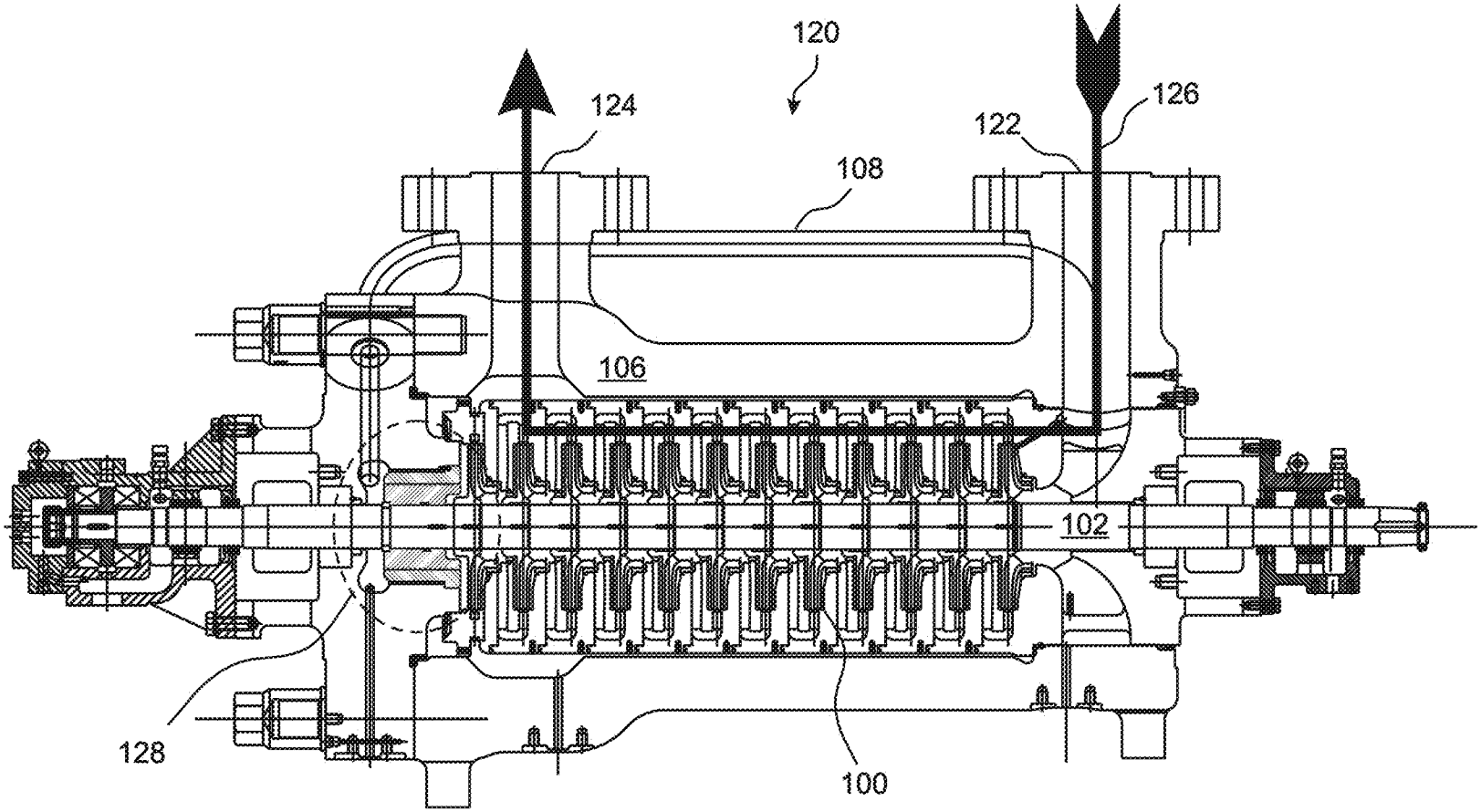
Fig. 1A (prior art)
FIG. 1A is a sectional view of an in-line BB5 pump of the prior art that comprises a thrust compensation mechanism.
Figure 1B:
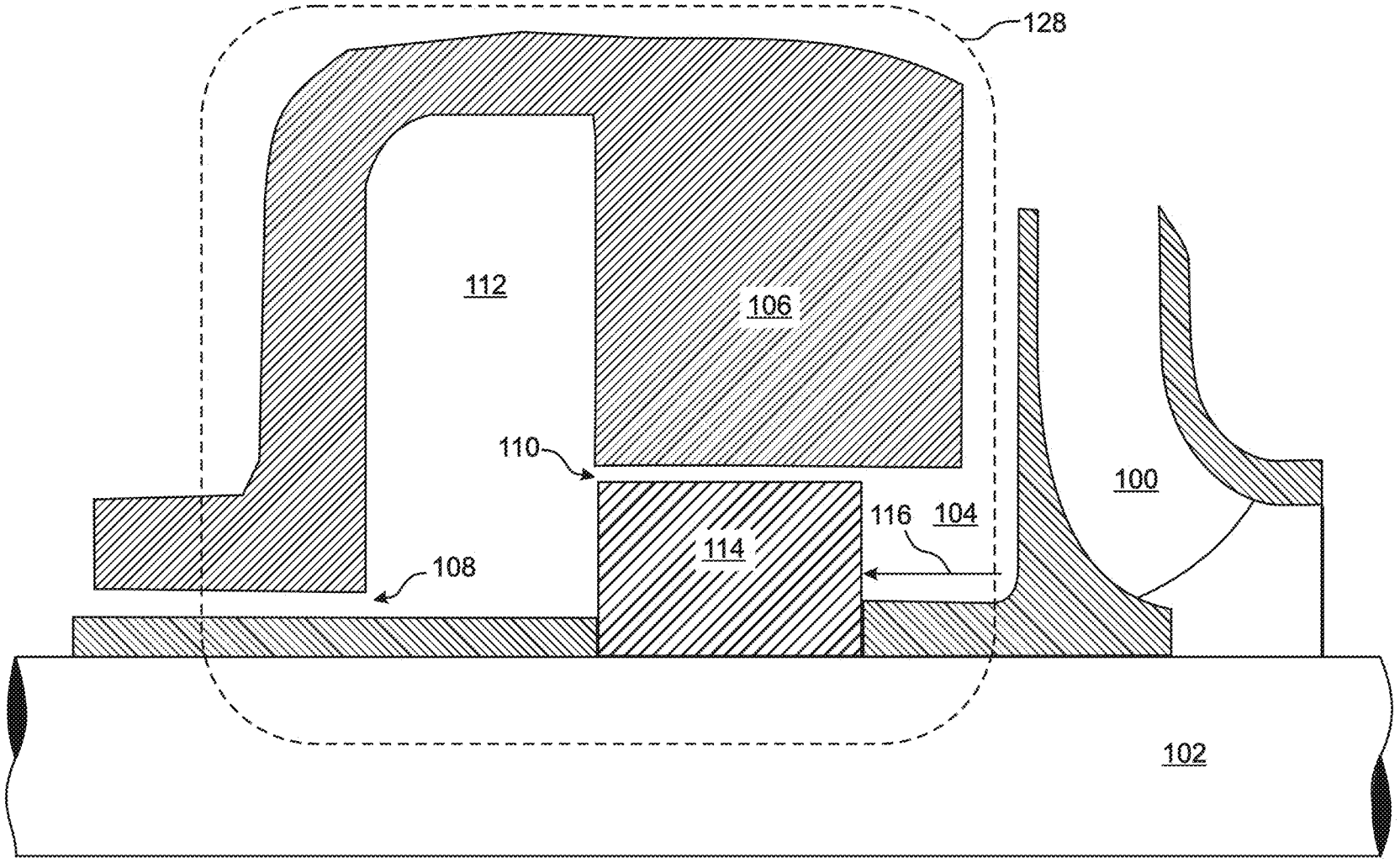
Fig. 1B (prior art)
FIG. 1B is a simplified illustration of a thrust compensation drum mechanism of the prior art.
Figure 1C:
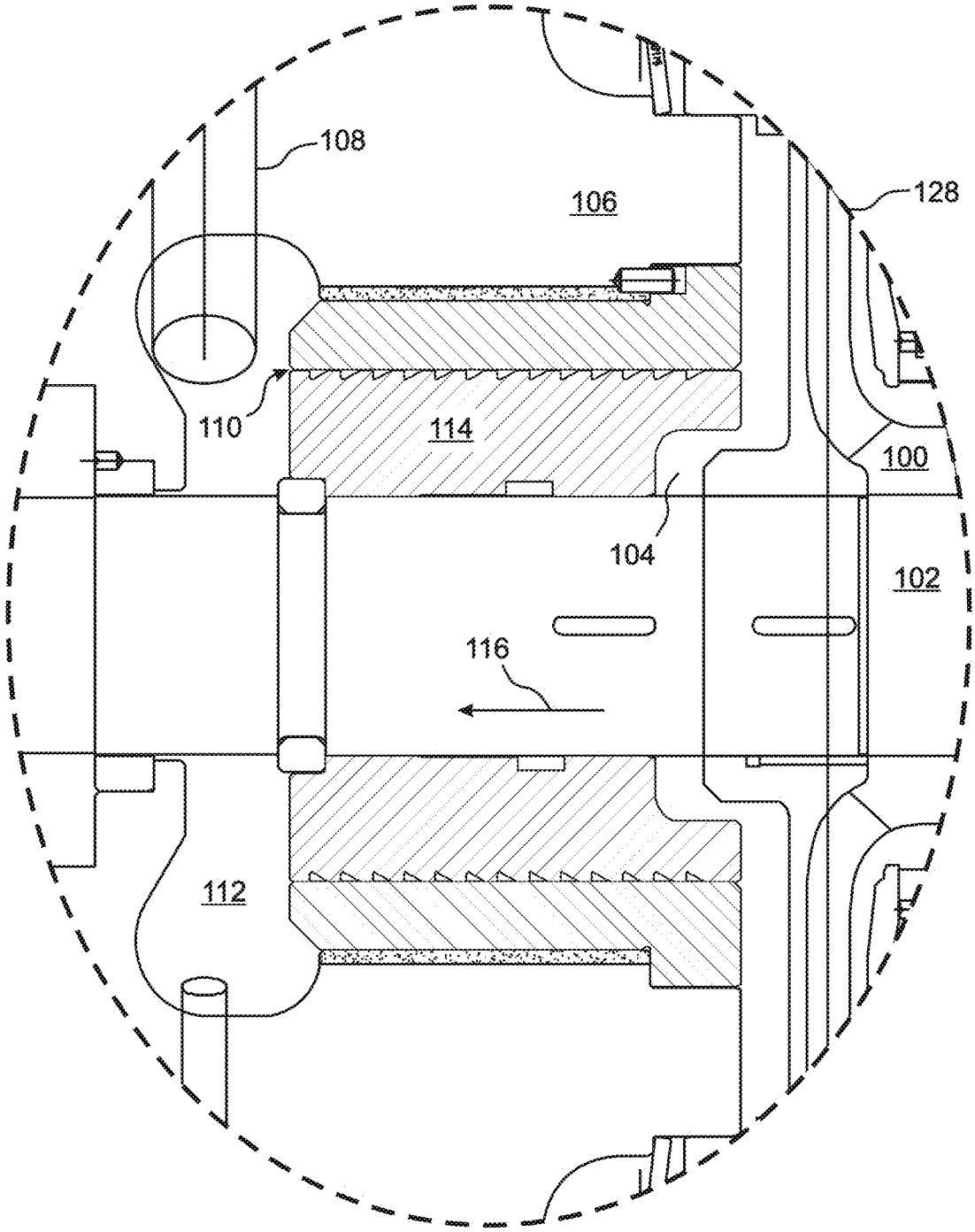
Fig. 1C (prior art)
FIG. 1C is a close-up view of the thrust compensation mechanism of FIG. 1A.

A further benefit of the present invention is that, by dividing the impellers into two groups 302, 304 operating in parallel, the minimum input pressure NPSHr (net positive suction head required) that is required to avoid cavitation damage within the pump 300 is less than what would be required for a conventional multistage centrifugal pump having similar performance, such as the examples of FIG. 1A and FIG. 2, in which a single flow path 126, 206 directs the process fluid through all of the impellers 100 in series.

Figure 3B:
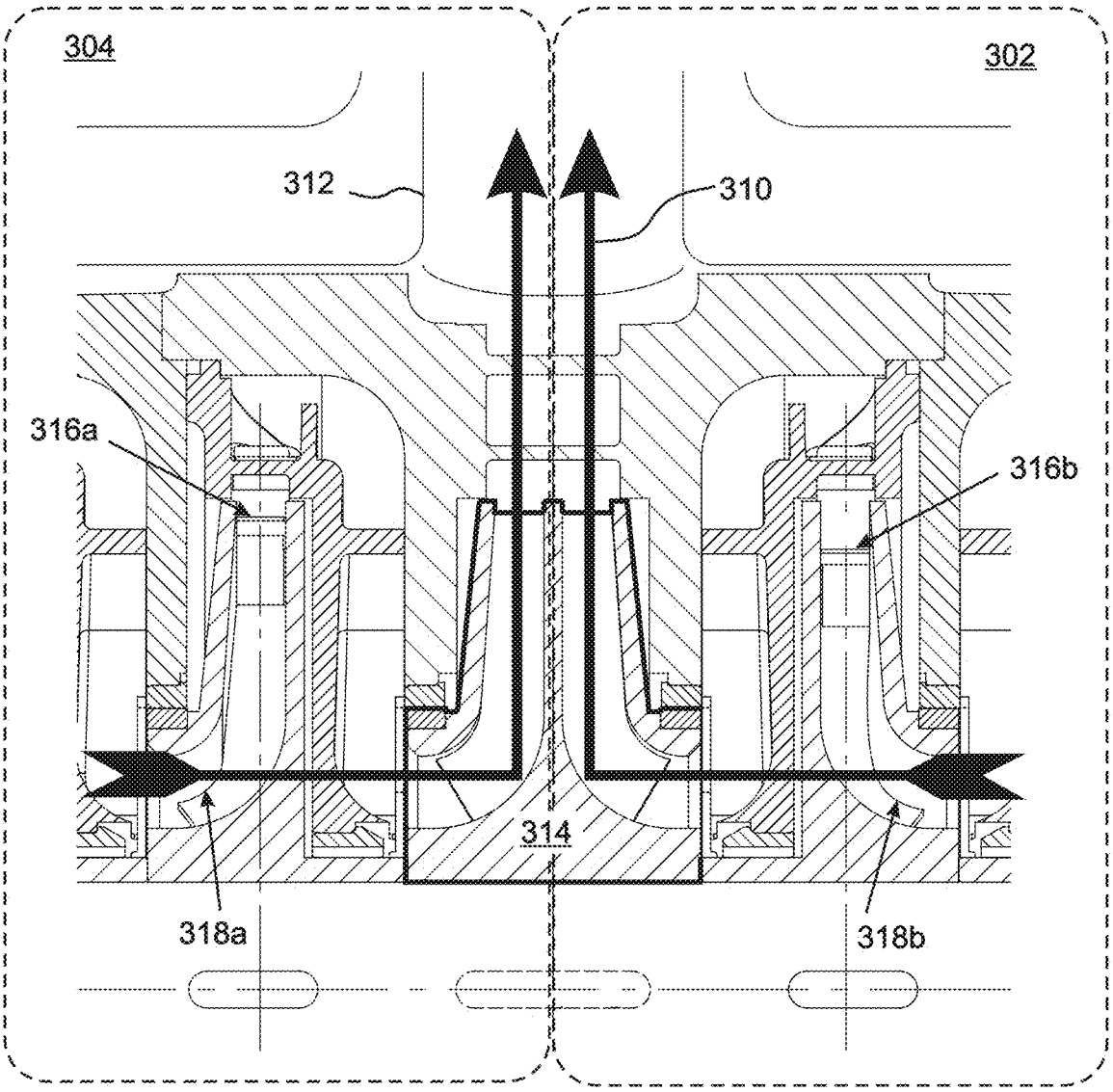
FIG. 3B is a close-up view of the double-suction impeller included in the BB5 pump of FIG. 3A.
Figure 4:
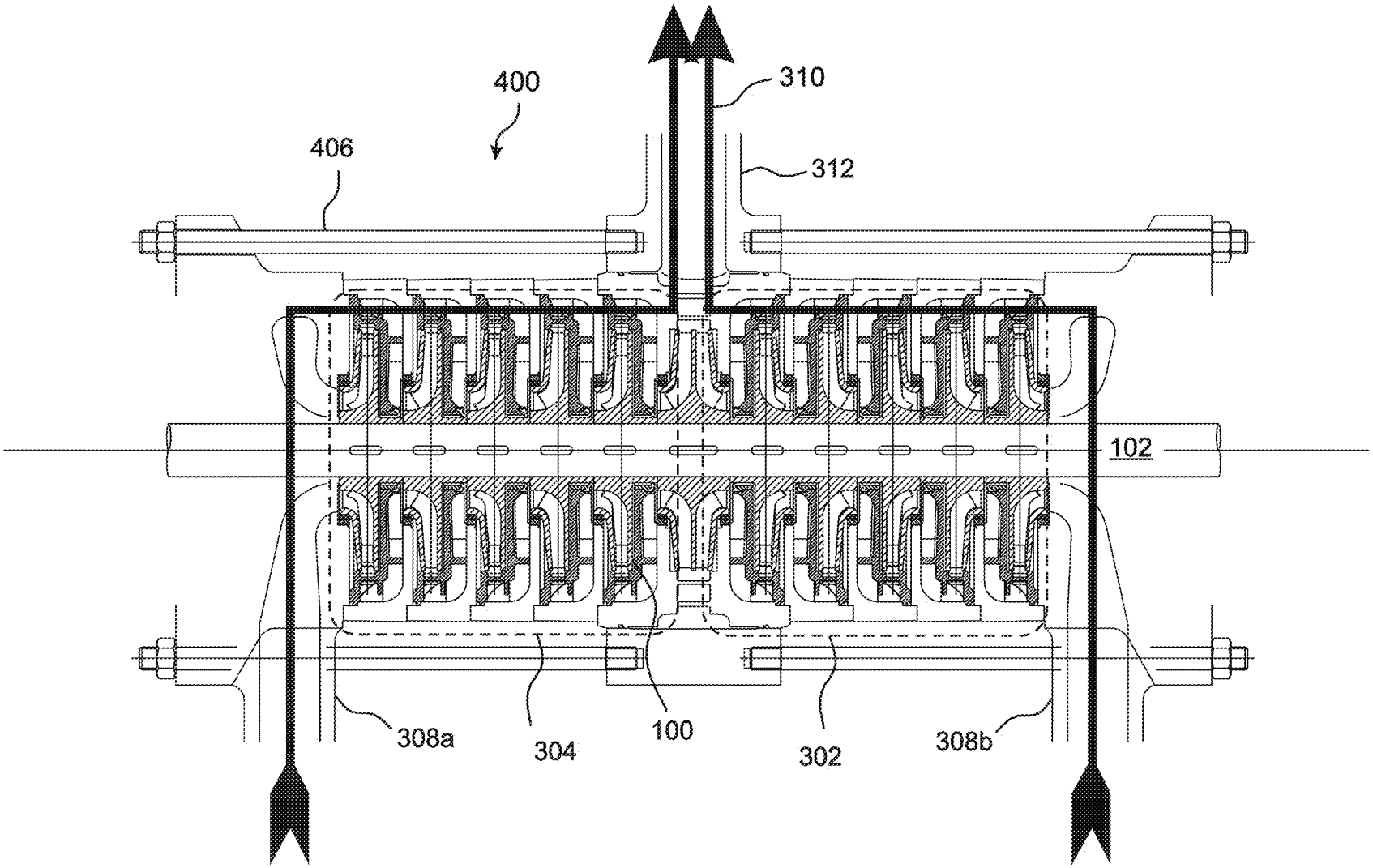
FIG. 4 is a cross-sectional side view of a BB4 pump in an embodiment of the present invention.

FIG. 3A is a cross-sectional view of an embodiment 300 that is a BB5 pump, which is a radially split multistage centrifugal pump having a double casing 306. In the illustrated embodiment, with reference to FIG. 3B, the final, or outlet impellers of each of the impeller groups 302, 304, which are the closest impellers to the outlet 312, are fused together into a common, double-suction impeller 314. FIG. 4 is a cross-sectional view of an embodiment 400 that is similar to FIG. 3A, except that it is implemented as a BB4 pump having a single casing 406.

Due to manufacturing tolerances, a rotating shaft 102 will always have a certain axial "play" or range within which it can move freely if no axial thrust is applied. As a result, if the two impeller groups 302, 304 apply precisely equal and opposed axial thrusts to the rotating shaft 102, the rotor may tend to make random axial excursions within its axial range, which can result in damage and/or premature wear to the bearings and/or other mechanical components of the pump 300, 400.

Accordingly, in some embodiments of the present invention, a slight asymmetry is intentionally introduced into the pump 300, 400, between the two groups of impellers 302, 304, thereby creating a small residual axial rotor thrust that is supported by a thrust bearing. In this way, the rotor is positively maintained at one boundary of its axial range.

In some of these embodiments, the asymmetry is introduced by slightly varying the blade angle of one or more of the impellers 100, and/or by slightly varying the outer diameter of one or more impellers 100. Both of these approaches to introducing asymmetry are illustrated in FIG. 3B, where elements 316*a* and 316*b* indicate a difference in the diameters of the impellers, while elements 318*a* and 318*b* indicate a difference in the blade angles of the impellers.

Figure 5:
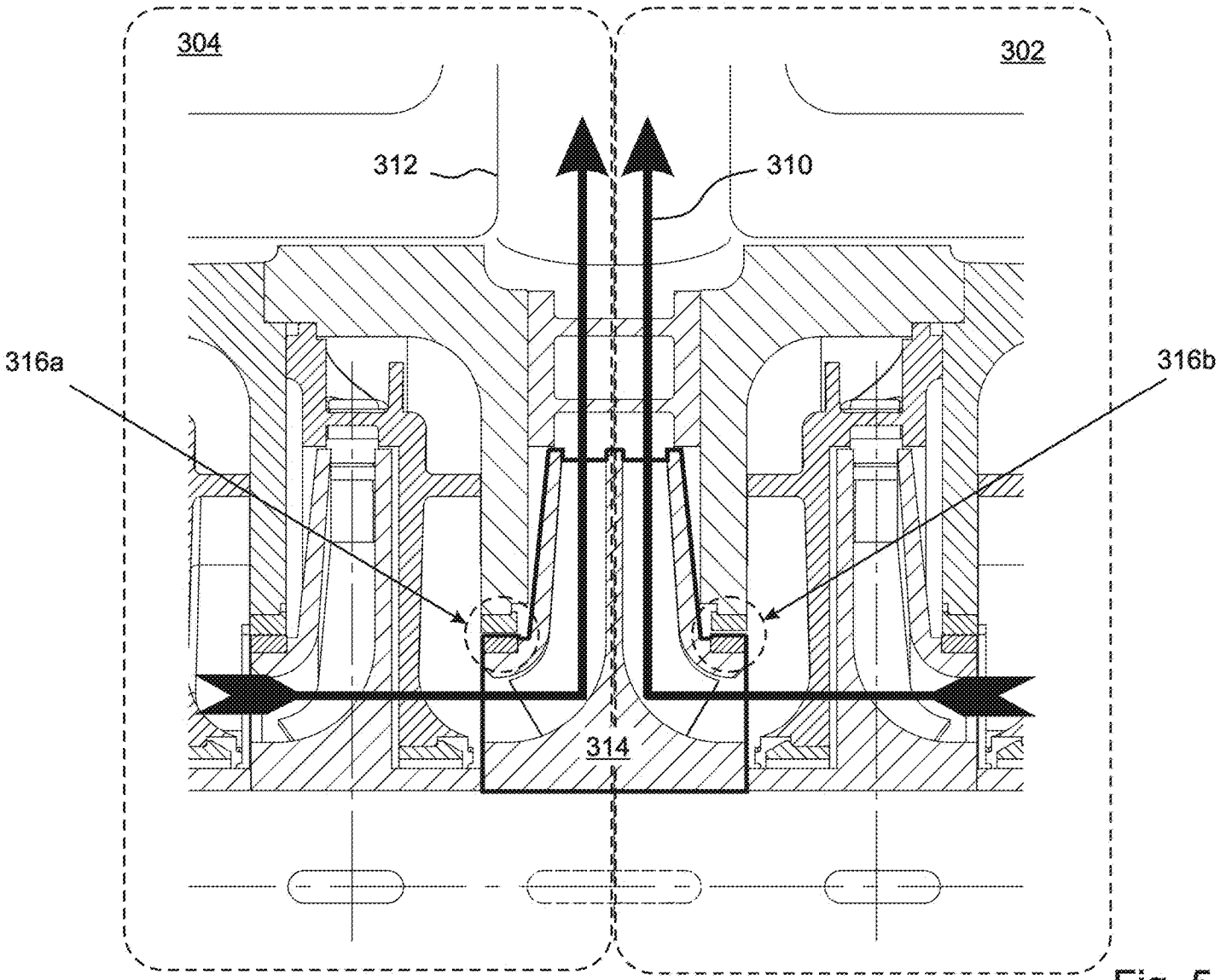
FIG. 5 is a close-up cross-sectional side view of a central region of a BB5 pump that is similar to FIG. 3B, but in which the gap between the wear rings on the double-suction impeller is smaller left side than on the right side.

With reference to FIG. 5, which is a close-up view of the central region of FIG. 3A, another approach is to widen the gap that is provided between the impeller wear ring and stator wear ring of at least one of the impellers 100 vary the inner diameter of one or more of the impellers 100 thereby increasing the leakage between the wear rings and introducing a controlled residual axial thrust. In the illustrated example, the gap between the wear rings 316*a* on the left side of the central, double-suction impeller 314 is smaller than the gap between the wear rings 316*b* on the right side of the central, double-suction impeller 314, thereby creating a small, intentional imbalance between the fluid pressure on either side of the central impeller 314 and consequently applying a small, intentional residual thrust to the rotor.

Embodiments implement any of several other approaches to introduce an asymmetry, which do not necessarily include differences between the impellers 100. For example, the leakage approach described above can be implemented by modifying only one or more of the stationary wear rings, without any modification of the impeller wear rings. As another example, embodiments implement a change to at least one stationary diffuser in the pump that is associated with one of the impellers 100.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. A multistage centrifugal pump having a barrel-type radially split casing, the centrifugal pump comprising:

a rotor comprising:

a rotating shaft supported by at least one bearing at each of two opposing ends thereof;

a first impeller group comprising a first group of N impellers fixed to the rotating shaft and configured to direct a process fluid in a first axial direction, N being an integer equal to one or greater; and a second impeller group comprising N impellers fixed to the rotating shaft and configured to direct the process fluid in a second axial direction that is opposite to the first axial direction;

a first fluid inlet configured to direct a first flow of the process fluid to an input of the first impeller group for direction thereby in the first axial direction;

a second fluid inlet configured to direct a second flow of the process fluid to an input of the second impeller group for direction thereby in the second axial direction; and a common outlet configured to form an outlet flow of the process fluid from the centrifugal pump by combining together the first and second flows of the process fluid after pressurization thereof respectively by the first and second impeller groups;

wherein a first axial thrust applied to the rotor by the first impeller group is substantially equal and opposite to a second axial thrust applied to the rotor by the second impeller group; and wherein the centrifugal pump does not comprise a flow compensation mechanism or a thrust compensation return line.

2. The centrifugal pump of claim 1, wherein the centrifugal pump is a between bearings single casing multi-stage centrifugal pump.

3. The centrifugal pump of claim 1, wherein the centrifugal pump is a between bearings double casing multi-stage centrifugal pump.

4. The centrifugal pump of claim 1, wherein all of the impellers of both of the impeller groups are substantially identical to one another.

5. The centrifugal pump of claim 1, wherein an impeller of the first group of impellers that is closest to the common outlet is included in a double-suction impeller that also includes an impeller of the second group of impellers that is closest to the common outlet.

6. The centrifugal pump of claim 1, wherein the first axial thrust is exactly equal and opposite to the second axial thrust.

7. The centrifugal pump of claim 1, wherein a residual axial thrust is applied to the rotor due to a difference between the first and second axial thrusts.

8. The centrifugal pump of claim 7, wherein the difference between the first and second axial thrusts arises at least in part due to a difference in an outer diameter of one of the impellers of the first impeller group and an outer diameter of a corresponding impeller of the second impeller group.

9. The centrifugal pump of claim 7, wherein the difference between the first and second axial thrusts arises at least in part due to a difference in a blade angle of one of the impellers of the first impeller group and a blade angle of a corresponding impeller of the second impeller group.

10. The centrifugal pump of claim 7, wherein the difference between the first and second axial thrusts arises at least in part due to a difference in a fluid leakage between wear rings supporting one of the impellers of the first impeller group and a fluid leakage between wear rings supporting a corresponding impeller of the second impeller group.

* * * * *